US005123038A

United States Patent [19]

Negle et al.

[11] Patent Number: 5,123,038

[45] Date of Patent: Jun. 16, 1992

[54] X-RAY GENERATOR FOR OPERATING AN X-RAY TUBE WITH PARTS OF THE TUBE CONNECTED TO MASS

[75] Inventors: Hans Negle, Nahe; Bernd Freiheit-Jensen, Hamburg, both of Fed. Rep. of Germany

[73] Assignee: U.S. Philips Corporation, New York, N.Y.

[21] Appl. No.: 578,985

[22] Filed: Sep. 6, 1990

[30] Foreign Application Priority Data

Sep. 8, 1989 [DE] Fed. Rep. of Germany ..... 3929888

[51] Int. Cl.[5] ..... H05G 1/54

[52] U.S. Cl. ..... 378/101; 378/114; 378/115; 378/118

[58] Field of Search ..... 378/91, 92, 119, 101, 378/114, 115, 118, 111, 107; 323/255, 258, 340, 343

[56] References Cited

U.S. PATENT DOCUMENTS 2,530,188 11/1950 Wright ..... 378/111
2,835,823 5/1958 Fransen ..... 378/111
2,870,340 1/1959 Fransen ..... 378/111
4,439,869 3/1984 Hermeyer et al. ..... 378/113
4,514,795 4/1985 van der Zwart ..... 363/2 T

FOREIGN PATENT DOCUMENTS 3046413 7/1982 Fed. Rep. of Germany .
3218535 11/1983 Fed. Rep. of Germany .
1357395 6/1974 United Kingdom .

*Primary Examiner*—Janice A. Howell
*Assistant Examiner*—Don Wong
*Attorney, Agent, or Firm*—William Squire

[57] ABSTRACT

An X-ray generator for operating an X-ray tube having parts of the tube connected to ground includes a high-voltage transformer arrangement having distinct secondary windings for producing positive and negative high voltages, for the anode and the cathode, respectively, of the X-ray tube. The unfavorable voltage distribution inherent in the feeding of such an X-ray tube by a high-ohmic generator is removed in a simple manner in that the secondary windings are each associated with a primary winding and that in series with the primary winding for producing the anode voltage an inductance is connected by means of a switching device.

8 Claims, 1 Drawing Sheet

X-RAY GENERATOR FOR OPERATING AN X-RAY TUBE WITH PARTS OF THE TUBE CONNECTED TO MASS

BACKGROUND OF THE INVENTION

1. Field of the Invention

The invention relates to an X-ray generator for operating an X-ray tube with parts of the tube connected to ground and a high-voltage transformer arrangement comprising distinct secondary windings for producing the positive and negative high voltages, respectively, for the anode and the cathode, respectively, of the X-ray tube. Such an X-ray generator is known from EP-B 74141 which corresponds to U.S. Pat. No. 4,439,869.

2. Description of the Prior Art

In X-ray tubes having a part of the tube connected to ground, for example, a metal envelope which optionally may be connected to a metal part present between the anode and the cathode, the current produced at the cathode does not flow completely to the anode; a part of the current flows to ground via the part of the tube in question. As a result of this, the high-voltage source on the cathode side is loaded more strongly than the high-voltage source on the anode side, which in high-ohmic symmetrically arranged high-voltage sources leads to an asymmetry between the high voltage on the anode and the cathode, respectively, (i.e. the high voltage between anode and ground exceeds the high voltage between cathode and ground).

This asymmetry involves negative effects which depend on the value of the voltage between anode and cathode:

a) at high tube voltages the voltage between anode and ground reaches a value of more than half of the maximally permissible tube voltage before the voltage between anode and cathode reaches its maximally permissible value. In order to avoid a high-voltage overload of the X-ray tube, the X-ray tube may in such a case not be operated with the full voltage for which it is designed.

b) at low tube voltages the cathode voltage may become so low that the current emitted at the cathode is limited by space charge effects. In order to reach a given tube current the filament current for the cathode must in this case be made unnecessarily large, which may lead to a reduction of the life of the tube.

In the known X-ray generator the voltage asymmetry and the negative effects produced thereby are removed in that a high-voltage transformer is provided having a primary winding and three secondary windings each with a rectifier. The three rectifier outputs are connected together via a switching device in such a manner that the high voltage of the anode side is optionally produced by one or two rectifiers and the high voltage of the cathode side conversely by two and one rectifier, respectively. The cost for this solution (additionally one secondary winding, one high-voltage rectifier and one high-voltage switching device) is comparatively high.

SUMMARY OF THE INVENTION

It is an object of the invention to remove the undesired effects at lower cost.

According to the invention this object is achieved in that a primary winding is associated with each of the two secondary windings and that in series with the primary winding for producing the anode voltage an inductance is switched by a switching device.

According to the invention, each secondary winding is also associated with a primary winding so that the voltages at the secondary windings can at least be preset in a certain range independently of each other. Assuming that the primary windings and also the secondary windings correspond to each other, the X-ray generator according to the invention provides a symmetric voltage distribution to a "normal" X-ray tube, i.e. an X-ray tube without parts of the tube connected to ground potential, for example, an X-ray tube having a glass envelope, which means that the value of the voltage between anode and ground potential is equally large as that of the voltage between cathode and ground potential. However, when an X-ray tube is connected the anode current of which differs from the cathode current, an inductance is switched in series with the primary winding for producing the high voltage of the anode side. As a result of this the voltage of the primary winding on the anode side is reduced as compared with the voltage on the primary winding on the cathode side, as a result of which, with suitable setting of the values of the inductance, the anode voltage is reduced at least approximately by the same amount as the cathode voltage as a result of the higher cathode current.

However, it is also possible to set the inductance value so that the anode voltage reduces more strongly than the cathode voltage so that the cathode voltage is larger than half the tube voltage—so long as the cathode voltage does not exceed half of the maximum tube voltage. In this case the space charge in the area of the cathode can be removed so that at a given cathode temperature the current through the cathode tube can be increased or with a given tube current the cathode temperature can be reduced and hence the life of the cathode can be extended.

In principle it would be possible to provide separate transformers for producing the cathode voltage and the anode voltage and to arrange the additional inductance in series with the primary winding of the transformer for the anode voltage. The cost involved for two separate transformers, however, is still comparatively high and also requires additional space for the two high-voltage transformers. A preferred embodiment therefore provides that the primary windings and the secondary windings are wound on a common core and are arranged so that the leakage inductance between the associated primary and secondary windings is essentially smaller than the leakage inductance between the windings which are not associated with each other.

When several windings are wound on a common core in such a manner that substantially the same inductance flows through them, the voltage in the windings are preset so that a separate control of the primary winding and secondary windings for the anode and the cathode, respectively, does not seem possible. However, with a high-voltage transformer for an X-ray tube the primary windings and the secondary (high voltage) windings must be insulated from each other which results in a given leakage flux or leakage inductance between the associated primary and secondary windings. When it is ensured by a suitable arrangement of the windings that the leakage flux or leakage inductance between windings which are not associated with each other (for example, between the primary winding for the anode voltage and the secondary winding for the cathode voltage) still becomes essentially larger than the leakage flux or leakage inductance between associated windings, the winding pairs behave within certain limits as two separate high-voltage transformers.

In another embodiment of the invention it is ensured that the inductance consists of several series-arranged sub-inductances and that switches are coupled to the sub-inductances in such a manner that the series inductance value is set by switching one or more of the switches to couple in one or more of the sub-inductances to the primary winding. This embodiment permits the stepwise adapting of the inductance arranged in series with the primary winding of the anode side to the relevant requirements: at high tube voltages a comparatively small inductance is switched by means of the switches which inductance is set so that the value of the anode voltage and cathode voltage is at least approximately equal. At lower tube, voltages a larger inductance is coupled in so that the cathode voltage becomes larger than the anode voltage, which enables a reduction of the cathode temperature with a given tube current.

A further embodiment of the invention constructs the inductance as an air-core coil. In principle the inductance could also be formed by a coil having a ferromagnetic core. However, since the required inductances are comparatively small, such a coil would have only one or a few turns so that an exact proportioning would be difficult. Moreover, saturation phenomena would occur in such a coil due to the high current which may flow through the primary winding (a few hundred A). An air-core coil, i.e. a coil without a ferromagnetic core, on the contrary may have a sufficient number of turns and does not show saturation effects.

In still a further embodiment of the invention the inductance is wound on an annular core. An air-core coil could in itself be wound particularly simply on a cylindrical core. An air-core coil with turns distributed uniformly on the circumference of the (non-ferromagnetic) annular core is more difficult to wind, but produces a smaller magnetic stray field in its surroundings.

IN THE DRAWINGS

The invention will now be described in greater detail with reference to the drawing, in which.

DESCRIPTION OF THE PREFERRED EMBODIMENT

Figure 1:
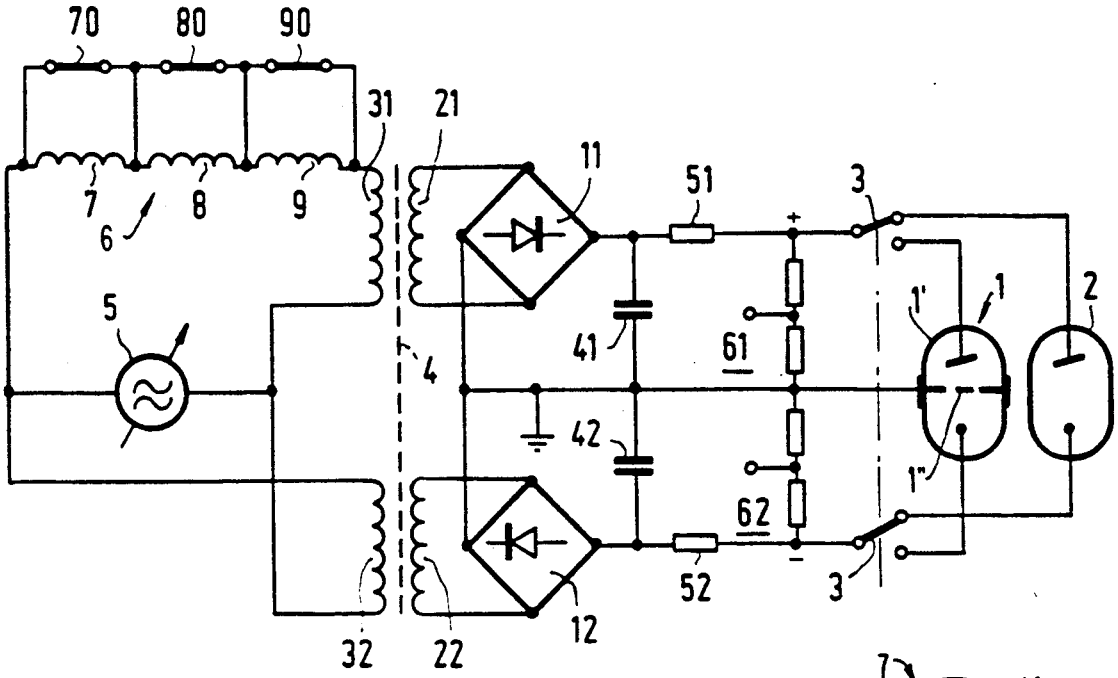
FIG. 1 is a principle circuit diagram of a part of an X-ray generator according to the invention.

In FIG. 1 two X-ray tubes 1 and 2 are provided which may optionally be connected to an X-ray generator. Whereas in the X-ray tube 2 the cathode current is exactly as large as the anode current because the tube comprises, for example, a glass envelope, this is not the case with the X-ray tube 1. As is shown diagrammatically, the X-ray tube 1 comprises a grounded metal envelope 1 and a central part 1 connected electrically therewith and arranged between the anode and cathode. In such a cathode tube which is known per se (for this purpose compare EP-OS 74141) a part of the cathode current can flow to ground via the central part and the metal envelope so that the cathode current exceeds the anode current.

One of the two X-ray tubes 1 or 2 which are located in different sites (in clinical practice more X-ray tubes may be provided) may be connected to the high voltage generated in the X-ray generator by means of a high-voltage switching device 3—which may be coupled to the operating sites selector which is not shown. The high voltage for the rectifier bridges 11 and 12, respectively, is provided by the secondary windings 21 and 22, respectively, to which primary windings 31 and 32, respectively, are associated. The four windings are wound on a common transformer core 4. Instead of the secondary windings 21 and 22, respectively, a secondary winding arrangement consisting of several individual windings may also be used.

The output voltages of the rectifier bridges 11 and 12, respectively, area smoothed by the capacitors 41 and 42, respectively and supplied to the switching device 3 via damping resistors 51 and 52, respectively. The positive and negative high voltage, respectively, to which one of the X-ray tubes 1 or 2 is connected in the operating condition, is detected for measuring and control purposes by voltage dividers 61 and 62, respectively.

Figure 2:
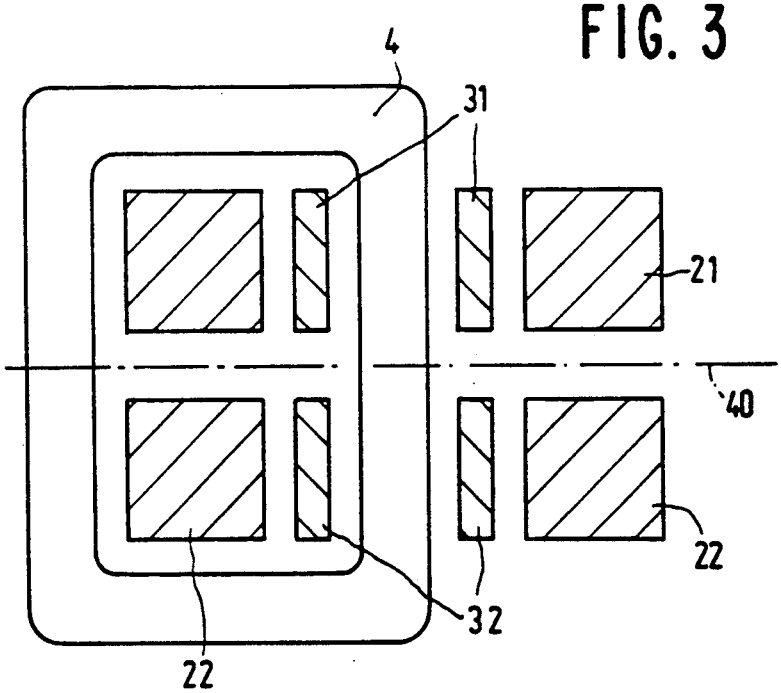
FIG. 2 is a cross-sectional view through the high-voltage transformer suitable for the generator of FIG. 1.

FIG. 2 is a cross-sectional view through the high-voltage transformer comprising the core 4, the two primary windings 31 and 32 and the two secondary windings 21 and 22. The core 4, a tape-wound core, has the form of a rectangular annular core. Such a core is advantageously composed of two identical cores having a U-shape so that the windings can be manufactured before they are provided on a core and before the two cores are put together. The secondary windings 21 and 22, respectively, enclose the associated primary windings 31 and 32, respectively, and the primary windings 31 and 32 enclose the same limb of the core 4. Since the primary windings have the same number of turns—as is the case with the secondary windings—a construction of the transformer which is symmetrical with respect to the center line 40 is obtained.

In this construction the magnetic coupling between non-associated windings—for example, between the primary winding 32 and the secondary winding 21 is essentially weaker and consequently the leakage inductance and the leakage flux is essentially larger, than between the associated windings, for example, between the primary winding 31 and the secondary winding 21. A ratio of the leakage inductances of 6:1 is sufficient to enable a non-symmetrical supply of the windings without impermissibly high equalizing currents flowing.

As is also shown in FIG. 1 the two primary windings 31 and 32 are fed by a controllable alternating voltage source 5, for example, with a medium frequency series resonance inverter at an operating frequency of, for example, 3–12 kHz. However, whereas the primary winding 32 for producing the cathode voltage is directly connected to the output of the alternating current source 5, an inductance 6 is connected in one of the connection leads between the primary winding 31 and the alternating voltage source 5. Inductance 6 comprises series-arranged sub-inductances 7, 8 and 9. A switch 70, 80 and 90 is connected across each of respective inductances 7, 8 and 9 in parallel. Whereas the primary and secondary windings must be in a container filled, for example, with transformer oil, the sub-inductances 7, 8 and 9 as well as the corresponding switches 70, 80 and 90, may be outside the container.

The X-ray generator is operated as follows: when the X-ray tube 2 is connected (in the shown position of the high-voltage switching device 3), all of the switches 70, 80 and 90 are closed so that the inductances 7, 8, 9 are short-circuited. The primary windings 31 and 32 are fed with equally large alternating voltages so that a symmetrical voltage distribution at the X-ray tube 2 is obtained, i.e. the value of the anode voltage is equally large as the cathode voltage (always with respect to ground potential).

For the connection of the X-ray tube 1, the high-voltage switching device 3 is switched to the position not shown in FIG. 1. At high tube voltages only one of switches 70, 80 and 90 is opened, in this case, for example, the switch 70, so that only the sub-inductance 7 in series with the primary winding 31 is operative. As a result of this, the voltage at the primary winding 31 is smaller than at the primary winding 32 and accordingly the no-load voltage at the output of the rectifier bridge (11 i.e. the voltage without load through the X-ray tube 1) is also smaller than the no-load voltage at the output of the rectifier bridge 12. As a result of the difference between the anode and cathode current, the operating voltage at the cathode decreases more strongly, however, then at the anode so that with a suitable setting of the value of the sub-inductance 7 at least approximately a symmetrical voltage distribution is set at the X-ray tube 1.

At lower tube voltages, two of the three 70, 80 and 90, or all the three switches, may be opened. The voltage at the primary winding 31 then decreases so much that the anode voltage is always smaller than the cathode voltage. The advantage of this asymmetrical operation is that with a given voltage between the anode and cathode, the maximally possible emission current can be increased and, that with a given tube current, the cathode temperature can be reduced, respectively, so that the life of the tube is extended.

So in this case, the switches 70, 80 and 90 must be controlled in accordance with the voltage at the X-ray tube. If only one switch is available and only one inductance, the control of that switch then occurs in accordance with the operating site selector (not shown) which also actuates the high-voltage switching device 3.

Figure 3:
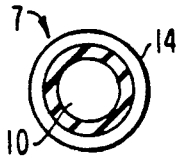
FIG. 3 is a sectional view through one of the coils forming a sub-inductance.

It comparatively small inductances 7, 8 and 9 are sufficient to achieve a symmetrical voltage distribution in an X-ray tube of the type of tube i.e., maximum operating voltage asymmetry (i.e. the difference between anode voltage and cathode voltage—without the inductance) of 14 kV could be compensated for substantially entirely by means of an inductance of approximately 13 $\mu$H. If for the manufacture of such a coil a ferromagnetic core would be used, the coil should have only one or a few turns so that a correct manufacture would be difficult. Moreover, saturation effects might occur in the core as a result of the very high currents flowing through the primary windings during operation (a few 100 A). Therefore the inductance 7, 8 and 9 are each constructed as an air-core. The turns 14 of the air-core coil e.g., inductance 7, FIG. 3 are preferably wound, uniformly distributed, on a non-ferromagnetic annular core 10 so that in the proximity of the air-core coil only small magnetic stray fields occur.

We claim:

1. An X-ray generator for operating an X-ray tube having a portion thereof connected to a reference potential comprising:

an alternating current voltage source;

a high-voltage transformer comprising a plurality of primary windings one of which for providing an anode voltage and a second of which for providing a cathode voltage and a like plurality of secondary windings, each secondary winding associated with a different primary winding; and means for selectively coupling an inductance in series with the anode voltage primary winding and said source.

2. An X-ray generator as claimed in claim 1 wherein the inductance coupled in series comprises several series-arranged sub-inductances and a switching device coupled to the sub-inductances in such a manner that the sub-inductances can be switched entirely or only partly to the anode voltage primary winding.

3. An X-ray generator as claimed in claim 1 wherein the inductance coupled in series is formed as an air-core coil.

4. An X-ray generator as claimed in claim 3, wherein the inductance coupled in series is wound on an annular core.

5. The generator of claim 1 including a core about which said primary windings and secondary windings are wound, said windings being arranged so that the leakage inductance between the associated primary and secondary windings is essentially smaller than the leakage inductance between the non-associated windings.

6. An X-ray generator as claimed in claim 6 wherein the inductance coupled in series comprises several series-arranged sub-inductances and a switching device coupled to the sub-inductances in such a manner that the sub-inductances can be switched entirely or only partly to the anode voltage primary winding.

7. An X-ray generator as claimed in claim 6 wherein the inductance coupled in series is formed as an air-core coil.

8. An X-ray generator as claimed in claim 2 wherein the inductance coupled in series is formed as an air-core coil.

* * * * *